United States Patent [19]

Sautebin et al.

[11] Patent Number: 4,699,204

[45] Date of Patent: Oct. 13, 1987

[54] DEVICE AND PROCESS FOR THE CONTINUOUS CASTING OF METALS

[75] Inventors: Raoul Sautebin, Mollens; Jean-Claude Weber, Sierre; Carlo Alborghetti, Loc, all of Switzerland

[73] Assignee: Swiss Aluminium Ltd., Chippis, Switzerland

[21] Appl. No.: 930,109

[22] Filed: Nov. 13, 1986

[30] Foreign Application Priority Data

Nov. 25, 1985 [CH] Switzerland ..... 5007/85

[51] Int. Cl.[4] ..... B22D 27/02

[52] U.S. Cl. ..... 164/467; 164/503

[58] Field of Search ..... 164/467, 503

[56] References Cited

U.S. PATENT DOCUMENTS 4,530,404 7/1985 Vives ..... 164/467

4,544,016 10/1985 Yetselev et al. ..... 164/467

*Primary Examiner*—Kuang Y. Lin

*Attorney, Agent, or Firm*—Bachman & LaPointe

[57] ABSTRACT

A device for contactless, vertically downwards continuous casting of metals in an electromagnetic alternating field, has an inductor and an electrically conductive, non-ferromagnetic screen that tapers downwards and features at a vertical distance 9 from this screen an electrically conductive, non-ferromagnetic counter screen that tapers upwards, the distance 9 between the said screen and counter screen being at least 2 mm, at most equal of the height of the inductor and in a continuous process which employs this device the circulation of the melt in the molten head of the ingot is reduced at least in the steady-state phase of casting. The process is particularly suitable for continuous casting aluminum alloys having a magnesium content of at least 2%.

19 Claims, 4 Drawing Figures

DEVICE AND PROCESS FOR THE CONTINUOUS CASTING OF METALS

BACKGROUND OF THE INVENTION

The present invention relates to a device for contactless, continuous casting of metals in the vertically downwards direction in an electromagnetic alternating field having an inductor, a coolant chamber featuring a device for directing a coolant onto the surface of the cast metal strand or ingot, and a electrically conductive non-ferromagnetic scrren that tapers downwards and is situated above the plane defined by the lowest lying edge of the inductor.

Also within the scope of the present inveniton is a process for contactless, vertical downwards continuous casting of metals in such a device, and an application of this process.

With such electromagnetic continuous casting units the molten metal is poured on to a dummy base situated within an inductor loop. The dummy base is lowered at a give rate. A high frequency alternating current in the inductor creates an electromagnetic field which restrains the molten metal horizontally within the inductor in a shape which is determined essentially by innter contours of the inductor loop. By jetting the surface of the downwards moving strand with a coolant, for example water, rapid solidification of the surface layer takes place. In order to adjust the magnetic field forces to accommodate the metallostatic pressure in the molten part of the strand, a scrren for example of stainless steel and also in the form of a loop is situated within the inductor loop.

A significatn advantage of the electromagnetic continuous casting unit over the conventional type is the much more uniform surface of the cast strand or ingot which is free of cold shuts, bleeding and surface segregation as a result of which scalping is unnecessary in most cases.

Further design aspects of such electromagnetic molds are aimed at correcting any inconsistencies in flatness and solidifcation conditions. For example the patent DE-C-2 No. 848 808 describes a mold which prevents concavity in broad rolling ingots by special shaping of the inductor. The patent EP-B-0 No. 015 870 proposes a fine regulation of the angle and region of impact of the coolant by controlled deflection of the coolant stream, this in order to be able to adjust the solidification conditions optimally to suit the various alloys and casting speeds. Proposed in patent EP-B- No. 062 606, as a means of avoiding convex doming of the bottom end of the ingot due to nonstationary cooling conditions during the start of the drop, is a deflection surface with recesses that is moveable parallel to the axis of the ingot and is inserted in the path of the coolant at least during the start-up phase. The patent EP-B- No. 0 082 810 describes a further method for reducing the doming of the ingot bottom caused by extreme cooling of the ingot. In that case, at least at the start of casting an addition is made to the coolant viz., a substance which on contacting the hot ingot surface decomposes to form a gas and thus forms an insulating film there that reduces the rate of that extraction.

Described in patent EP-B- No. 0 109 357 is the design of an electromagnetic continuous casting mold which can be adjusted for different ingot cross-sections without reducing the dimensional accuracy of the ingot contour.

The electromagnetic field produced by the inductor creates in the molten head of the ingot being cast circulation of the melt which can for example cause the oxide skin to rupture. In such sensitive cases this disturbs the solidification conditions and lowers the quality of the melt in the region where the surface is solidifying; this then appears e.g. as an agglommeration of oxide inclusions, in longitudinal folds and in surface flaws of a kind which do not appear until later processing viz., as surface fines, looper lines and the like. Such ingots usually have to be scalped so that the advantages of electromagnetic casting cannot be fully exploited.

In view of the above the object of the present invention is to develop a device of the above mentioned kind by means of which the surface quality of cast ingot or strand and the products manufactured therefrom are improved, and in particular the circulation of the melt in the molten head of the ingot or strand can be reduced.

It is a further object of the invention to develop a process which improves the surface quality obtained by contactless, vertical downwards continuous casting of metals.

SUMMARY OF THE INVENTION

With respect to the device this object is achieved by way of the invention in that an electrically conductive, non-ferromagnetic counter screen that tapers upwards is mounted in the casting direction a distance from the screen, said distance being at least 2 mm at most equal to the height of the inductor. Screen to counter-screen distances greater that the height of the conductor do not contribute to the desired effect. Distances less than 2 mm hinder the general function of the continuous casting unit. The counter screen has to be electrically insulated from the other parts of the continuous casting unit.

During casting eddy currents are induced within the counter screen by the magnetic field of the inductor, provided the counter screen forms an electrically conductive closed loop around the ingot being cast. In another useful version the counter screen is arranged as a non-closed loop around the ingot and the open ends connected to an alternating current source. The counter screen loop can thereby also be subdivided into a plurality of non-connected sections the ends of which are connected individually to alternating current sources. The electromagnetic alternating field generated by these currents creates, along with the alternating field created by the inductor, forces which act counter to the stirring forces in the molten head of the ingot being cast. The intensity of melt circulation is thus reduced.

With respetc to the process the object is achieved by way of the invention in that casting is performed in a device according to the invention and, at least in the steady-state phase of casting, the circulation of th emelt int he molten head of the ingot is reduced.

During the start-up phase the melt circulation should preferably not be markedly influenced by the counter screen and the inductor should contain the melt without any trace of restriction by the counter screen; in the subsequent steady-state phase of casting, however, the counter screen must exercise the effect of reducing the circulation.

In a particularly useful version of the casting device the counter screen is provided with a space to accommodate a coolant, The said coolant circulating therein serves to cool the counter screen. Such a counter screen preferably features coolant outlets that run from the space inside and are directed at the surface of the ingot. The coolant for the counter screen can thus be used as additional cooling for the ingot. Used in accord with the normal ingot cooling from the coolant chamber, this enables an optimal step-wise arrangement of the cooling and contributes therefore to the improvement in surface quality.

In a preferred version within the scope of the invention the casting device is designed such that the counter screen can be moved vertically, wherewith the distance t o he upper screen can be changed. In a corresponding useful version the counter screen is mounted to the coolant chamber and this in such a way that it can be displaced vertically.

Mounted at selected places on the vertically adjustable counter screen are electric coolant flow baffles which project vertically beyond the counter screen by at most the height corresponding to the distance of the screen from the counter screen. This enables also the coolant feed to be altered locally by displacement of the counter screen. The positions for the counter screens are chosen according to those positions at the ingot periphery where a smaller amount of cooling is required, for example at the corner regions of ingots of rectangular cross section.

Also within the scope of the invention is a device which represents an alternative to the versions with adjustable distance spacing of the counter screen, in which the screen is rigidly attached to the counter screen by means of at least one dielectric intermediate piece. The said intermediate piece can extend over the whole horizontal periphery of the counter screen and be interrupted essentially only by the outlets for the coolant.

A further solution according to the invention is such that the counter screen forms, around the ingot, a loop which is not closed but is interrupted by sections which are not electrically conductive. These sections should be short and can be formed, for example, by an air gap between the counter screen parts. This counter screen is provided with moveable, electrically conductive contact elements which are able in one position to bridge the non-conductive sections electrically and so to close the counter screen loop. These bridging contact elements can for example be designed like the clamping devices described in the patent EP-B- No. 109 357.

Changing the vertical distance between the lowest edge of the screen and the uppermost edge of the counter screen has been found to be a useful way of influencing the action of the counter screen on the continuous casting process according to the invention. In this connection the relation between the height of the inductor and the screen distance has been found to be decisive. Good results are obtained by adjusting the distance in the start up phase to at least half and at most the whole height of the inductor and reducing this distance after changing over to the steady-state condition to a value between 2 mm and half the height of the inductor.

An alternative method of influencing the effect of the counter screen within the scope of the invention is to employ a casting device in which the counter screen is interrupted by non-electrically conductive sections, and features moveble electrically conductive contact elements that can adopt a position in which the non-conductive section is bridged and the sounter screen loop is closed. In the start-up phase at least one contact element is in the open position so that the loop is not closed and the counter screen does not lead to any the eddy currents induced by the inductor. In the steady-state phase the contact elements are then brought into the briding position so that the counter screen can exert its full influence on the circulation of the melt in the head of the ingot strand. This process offers the possibility of omitting the capability to adjust the counter loop in the vertical direction.

A preferred method for influencing the counter screen effect is such that use is made of a counter screen which forms a loop interrupted in one or more places. The ends of these loop sections are connected, at least in the steady-state phase, in pairs to an alternating current source which has the same frequency as the inductor current and the same electrolytic alternating field produced by it. Such a current, fed directly into the counter screen loop, enables optimal adjustment of the counter screen effect on melt circulation in the ingot head. In that respect a process which has been found to be particularly suitable is one in which, in the steady-state condition, a phase shift of 150° to 180° C. is introduced between the current source and the current flowing in the inductor. The amplitude of the counter screen current should be smaller than the amplitude of the inductor current.

Within the scope of th einvention is an improvement in the surface of the continuously cast ingot by refining the cooling conditions in that, in addition to the coolant stream from the coolant chamber, the ingot surface is jetted at a lower zone by coolant emerging from outlets in the counter screen.

A preferred version of this process is to allow a coolant to be jetted from the coolant chamber viz., a coolant which, for example as described in patent EP-B- No. 0 082 810, contains a substance that on impinging on the ingot surface releases a gas, for example nitrogen or carbon dioxide, which forms an insulating film. For better cooling in a lower zone, the coolant from the outlets in the counter screen jetting onto that zone breaks up this insulating layer.

BRIEF DESCRIPTION OF THE DRAWINGS

Further advantages, features and details of the invention are revealed in the following description of a preferred exemplified embodiment with the aid of the drawings wherein.

p DETAILED DESCRIPTION

Figure 1:
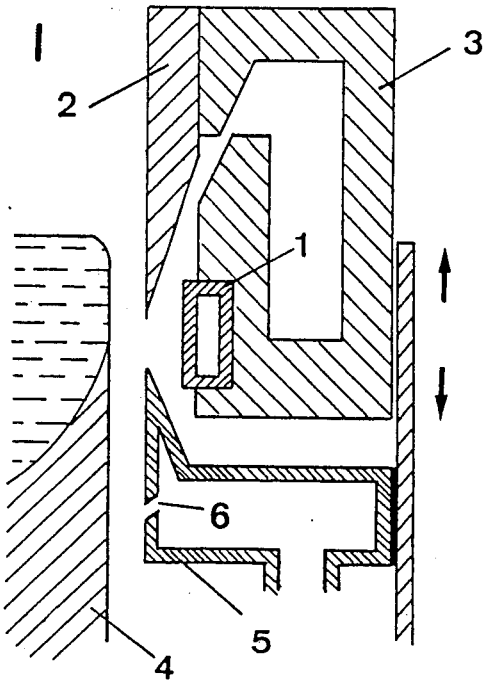
FIG. 1 is a schematic cross-section through a part of a continuous casting device according to the invention showing vertically displaceable counter screen and the ingot being cast.
Figure 2:
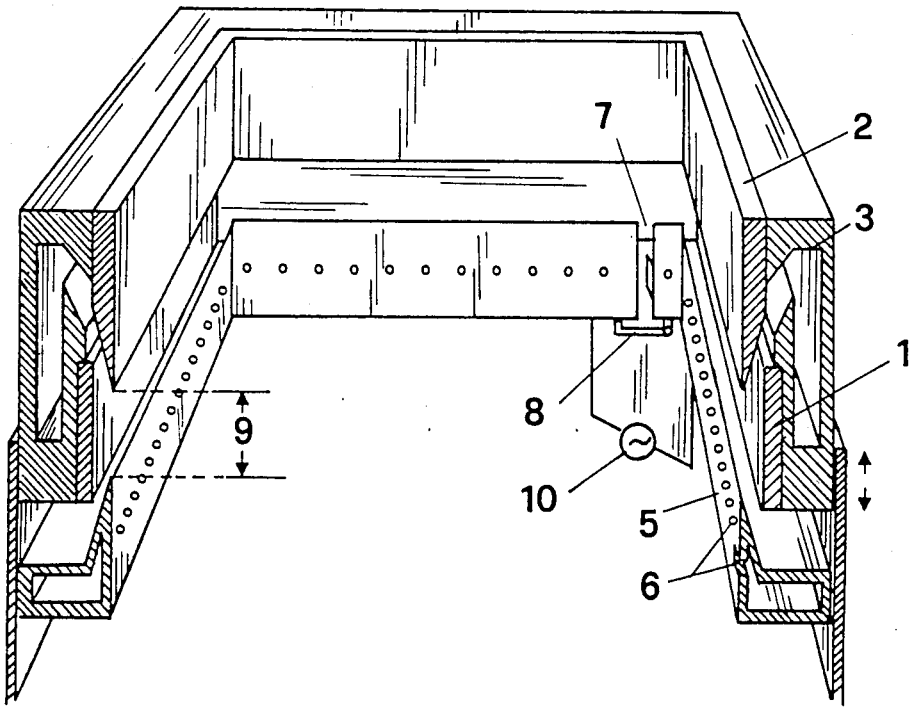
FIG. 2 is a schematic perspective view of a rectangular continuous casting unit which is sectioned through a plane running through the axis of the ingot.

The electromagnetic continuous casting unit shown in FIGS. 1 to 4 features an inductor 1 which is hollow to permit cooling from the inside. The inductor is embedded on one side in a coolant chamber 3. Circulating in that chamber 3 is a coolant fluid, not shown here, that is conducted onto the surface the ingot 4 by means of a device. The screen 2 is attached to the coolant chamber 3. Its lower edge lies by about one third of the height of the inductor 1, lower than the upper edge of the inductor 1. Situated below the coolant chamber 3 is a counter screen 5 featuring a space inside to accomodate a coolant fluid which is not shown here. The medium circulating therein cools the counter screen 5; in addition, the coolant emerges via openings 6 which are directed at a lower zone on the surface of the ingot 4. The counter screen which tapers upwards with an angle of 20°(specified: 10° to 45°) has its upper edge higher than the lower edge of the inductor 1. The distance 9, in FIG. 1, of this upper edge from the lower edge of the screen 2 amounts to 45% of the height of the inductor 1 which is 60 mm in height. This configuration corresponds to the steady-state casting phase. The counter screen is vertically displaceable by means of a plate attached to the coolant chamber 3 by a means of fixing not shown here. The distance 9 can thus be varied between 2 mm and 60 mm. Apart from this the continuous casting unit shown in FIG. 2 combines the two further facilities which influence the action of the counter screen 5 on the molten head of the cast ingot 4. The counter screen 5 is interrupted at least in one corner of the unit by a gap which is a nonconductive section 7. A schematically represented electrically conductive contact element 8 is attached to one side of section 7 and bridges this section in a closed position in which the contact element makes electrical contact with the other side of section 7 on the counter screen 5. If no induced current should flow in the counter screen 5 during start up, then the contact element 8 is brought into a position which does not effect bridging of section 7.

For direct feeding of an additional alternating current into the loop of the counter screen 5 this is provided on both sides of section 7 with electrical contacts which can be connected up to the alternating current source 10. As shown here the contact elements 8 are in the closed position.

Figure 3:
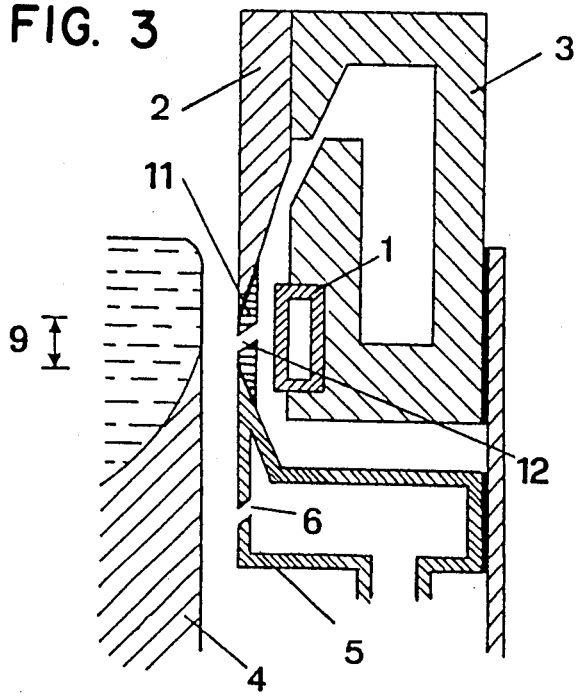
FIG. 3 is a schematic cross-section through a version of the continuous casting device according to the invention having a rigid connection between the screen and the counter screen.
Figure 4:
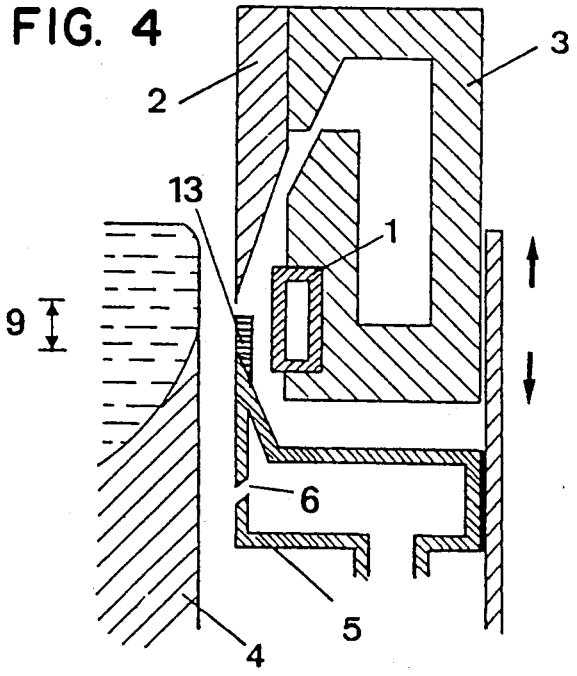
FIG. 4 is a schematic cross-section through a further version of the continuous casting device according to the invention having displaceable counter screen and coolant flow baffle mounted on it.

FIG. 3 shows an alternative version of the continuous casting unit 1 shown in FIG. 1. There the counter screen 5 is rigidly attached to the screen 2 via a dielectric intermediate piece 11. This is provided with coolant outlets which are situated at a suitable spacing around the ingot.

Shown in FIG. 4 is again a continuous casting unit with vertically adjustable counter screen 5. The cross-section runs through a region close to a vertical edge of the ingot 4. A dielectric coolant flow baffle 13 is mounted on the upper edge of the counter screen 5. After changing over to the steady-state phase of casting, this covers two thirds of the distance 9 between the screen 2 and the counter screen 5, and thus diverts a greater part of the coolant emerging from the coolant chamber 3.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for contactless continuous castng of metals in the vertically downwards direction in an electromagnetic alternating field comprising an inductor, a coolant chamber featuring a device for directing a coolant onto the surface of the cast metal strand, and an electrically conductive nonferromagnetic screen that tapers downwards and is situated above the plane defined by the lowest lying edge of the inductor, the improvement comprising an electrically conductive, nonferromagnetic counter screen that tapers upwards is arranged in such a manner that the distance between the screen and the counter screen is at least 2 mm and at most equal to the height of the inductor.

2. A device according to claim 1 wherein the counter screen contains a hollow space to accommodate a coolant.

3. A device according to claim 2 wherein the counter screen features coolant outlets directed at the strand being cast.

4. A device accordig to claim 1 wherein the counter screen is rigidly attached to the coolant chamber by means of at least one dielectric intermediate piece.

5. A device according to claim 4 wherein the intermediate piece extends the whole periphery of the counter screen and is provided with coolant outlets.

6. A device according to claim 1 wherein the counter screen is vertically moveable in order to allow variation in the distance.

7. A device according to claim 1 wherein the counter screen is attached to the coolant chamber and is vertically adjustable.

8. A device according to claim 1 wherein dielectric coolant baffles are mounted on the counter screen at selected positions corresponding to those positions on the ingot periphery requiring less cooling, said baffles projecting vertically above the counter screen by at most a second distance equal to two thirds of the distance.

9. A device according to claim 1 wherein the counter screen forms a closed loop around the cast strand.

10. A device according to claim 1 wherein the counter screen forms, around the strand being cast, a loop which is interrupted by non-electrically conductive sections, said loop is bridged in a closed position by moveable, electrically conductive contact elements.

11. A device according to claim 1 wherein the counter screen forms, around the strand being cast, a closed loop which is interrupted at one place and has its open ends connected to an alternating current source.

12. A device according to claim 1 wherein the counter screen forms, around the strand being cast, a loop which is interrupted at a plurality of places so that it is subdivided into insulated sections each of which has its ends connected to alternating current sources.

13. A process for electromagnetically continuously casting molten metal comprising:

providing a support frame;

providing an inductor associated with said support frame for applying a magnetic field to the molten metal to define a mold cavity;

providing an electrically conductive, nonferromagnetic first screen which tapers downward in the direction of casting such that the lowest edge of the first screen is above the plane defined by the lowest edge of the inductor;

providing coolant supply means including at least one discharge nozzle defined by a portion of said support frame and said screen for feeding a coolant stream to the surface of a cast ingot;

providing an electrically conductive, nonferromagnetic second counter screen which tapers upward in the direction of casting such that the uppermost edge of the second counter screen is a distance below the lowest edge of the first screen;

start-up casting metal into said mold cavity;

providing the distance between said screen and said counter screen at a first value during said start-up casting;

steady state casting metal into said mold cavity; and providing the distance between said screen and said counter at a second value during said steady state casting wherein said second value is ≦ said first value.

14. A process according to claim 13 including providing current to said counter screen during said steady state casting so as to control and reduce the circulation of the melt in the molten head of the ingot being cast.

15. A process according to claim 14 wherein during the steady-state casting the counter screen is supplied with current directly from an altenating current source which has the same frequency as the electromagnetic alternating field from the inductor and a current amplitude which is smaller than that of the inductor.

16. A process according to claim 15 wherein during the steady-state casting a phase shift of 150° to 180° is introduced between the current fed from the alternating current source into the counter screen and the current flowing in the inductor.

17. A process according to claim 13 wherein the ingot being cast is jetted with coolant from coolant outlets on the counter screen.

18. A process according to claim 17 wherein on jetting the coolant from the at least one discharge nozzle onto the surface of the ingot a gas is released and the insulation layer thus produced is broken down by the coolant emerging from the coolant outlets.

19. A process according to claim 13 including casting an aluminum alloy having a magnesium content of at least 2 wt.%.

* * * * *

UNITED STATES PATENT AND TRADEMARK OFFICE

CERTIFICATE OF CORRECTION

PATENT NO. : 4,699,204

DATED : October 13, 1987

INVENTOR(S) : Raoul Sautebin, Jean-Claude Weber and Carlo Alborghetti

It is certified that error appears in the above-identified patent and that said Letters Patent is hereby corrected as shown below:

Column 1, line 12, delete "scrren" and insert --screen--.

Column 1, line 16, delete "inveniton" and insert --invention--.

Column 1, line 26, delete "innter" and insert --inner--.

Column 1, line 32, delete "scrren" and insert --screen--.

Column 1, line 35, delete "significatn" and insert --significant--.

Column 1, line 43, delete "solidifcation" and insert --solidification--.

Column 1, lines 44, 46, 51, 58 and 66, delete "No.".

Column 2, line 54, delete "respetc" and insert --respect--.

Column 2, line 57, delete "th emelt" and insert --the melt--.

Column 2, line 58, delete "int he" and insert --in the--.

Column 2, line 68, delete "coolant," and insert --coolant.--.

Column 3, line 13, delete "t o he" and insert --to the--.

Column 3, line 48, delete "No.".

Column 3, line 66, delete "moveble" and insert --moveable--.

Column 3, line 68, delete "sounter" and insert --counter--.

UNITED STATES PATENT AND TRADEMARK OFFICE

CERTIFICATE OF CORRECTION

PATENT NO. : 4,699,204

DATED : October 13, 1987

INVENTOR(S) : Raoul Sautebin, Jean-Claude Weber and Carlo Alborghetti

It is certified that error appears in the above-identified patent and that said Letters Patent is hereby corrected as shown below:

Column 4, line 24, after "current", first occurrence, insert --fed into the counter screen from the alternating current--.

Column 4, line 28, delete "th einvention" and insert --the invention--.

Column 4, line 36, delete "No.".

Column 4, line 64, delete "p".

Column 6, line 20, delete "accordig" and insert --according--.

Signed and Sealed this

Eighth Day of March, 1988

*Attest:*

DONALD J. QUIGG

*Attesting Officer*

*Commissioner of Patents and Trademarks*